US008534251B2

(12) United States Patent
Baker et al.

(10) Patent No.: US 8,534,251 B2
(45) Date of Patent: Sep. 17, 2013

(54) ENGINE ASSEMBLY WITH CAMSHAFT HOUSING

(75) Inventors: Rodney E. Baker, Fenton, MI (US); Brian W. Geiser, Ortonville, MI (US); Cynthia Ann Stuvel, Leonard, MI (US); Gary L. Nye, Macomb, MI (US)

(73) Assignee: GM Global Technology Operations LLC

( * ) Notice: Subject to any disclaimer, the term of this patent is extended or adjusted under 35 U.S.C. 154(b) by 319 days.

(21) Appl. No.: 12/897,211

(22) Filed: Oct. 4, 2010

(65) Prior Publication Data

US 2011/0277725 A1 Nov. 17, 2011

Related U.S. Application Data

(60) Provisional application No. 61/345,380, filed on May 17, 2010.

(51) Int. Cl.
*F01L 1/04* (2006.01)

(52) U.S. Cl.
USPC ..... 123/90.6; 123/90.17; 123/90.27

(58) Field of Classification Search
USPC ..... 123/90.6, 90.27, 90.17, 193.5
See application file for complete search history.

(56) References Cited

U.S. PATENT DOCUMENTS

| | | | | |
|---|---|---|---|---|
| 4,823,747 | A * | 4/1989 | Wagner et al. | 123/193.5 |
| 5,704,330 | A | 1/1998 | Tsuchida | |
| 6,470,840 | B1 | 10/2002 | Ebesu et al. | |
| 6,796,281 | B2 | 9/2004 | Shimoyama et al. | |
| 7,165,522 | B2 * | 1/2007 | Malek et al. | 123/90.34 |
| 7,665,435 | B2 | 2/2010 | Imazato et al. | |
| 2001/0035142 | A1 * | 11/2001 | Ebesu et al. | 123/90.17 |
| 2005/0252470 | A1 | 11/2005 | Malek et al. | |

FOREIGN PATENT DOCUMENTS

| | | | |
|---|---|---|---|
| DE | 69414557 | | 4/1999 |
| DE | 60200923 | | 1/2005 |
| DE | 60123861 | | 2/2007 |
| JP | 2007285236 | A | 11/2007 |
| JP | 2008019842 | A | 1/2008 |
| WO | WO2008010051 | | 1/2008 |

* cited by examiner

*Primary Examiner* — Zelalem Eshete
(74) *Attorney, Agent, or Firm* — Harness, Dickey & Pierce, P.L.C.

(57) ABSTRACT

An engine assembly may include an engine structure, a first camshaft housing assembly and a first camshaft assembly. The first camshaft housing assembly may be supported by the engine structure and have a first portion providing a first plurality of bearing support surfaces on a first side and a second portion coupled to the first portion and providing a second plurality of bearing support surfaces on a second side opposite the first side. The first camshaft assembly may be rotationally supported by the first camshaft housing assembly and arranged between the first portion and second portion.

10 Claims, 5 Drawing Sheets

ENGINE ASSEMBLY WITH CAMSHAFT HOUSING

CROSS-REFERENCE TO RELATED APPLICATIONS

This application claims the benefit of U.S. Provisional Application No. 61/345,380, filed on May 17, 2010. The entire disclosure of the above application is incorporated herein by reference.

FIELD

The present disclosure relates to engine assemblies, and more specifically to an engine assembly that includes a camshaft housing.

BACKGROUND

This section provides background information related to the present disclosure which is not necessarily prior art.

An engine assembly may include an engine structure that rotationally supports a camshaft assembly. The camshaft assembly may include a plurality of lobes and bearing regions located on the exterior surface of a hollow tube. During operation of the engine, the camshaft assembly is rotated and the lobes act to open the intake and/or exhaust valves of the engine. The bearing regions provide the bearing surface for the support of the camshaft assembly. The engine structure may provide one bearing support surface for the bearing regions of the camshaft assembly. A plurality of bearing caps or a camshaft housing may be coupled with the engine structure and provide a second bearing support surface for the bearing regions of the camshaft assembly.

SUMMARY

This section provides a general summary of the disclosure, and is not a comprehensive disclosure of its full scope or all of its features.

An engine assembly may include an engine structure, a first camshaft housing assembly and a first camshaft assembly. The first camshaft housing assembly may be supported by the engine structure and have a first portion providing a first plurality of bearing support surfaces on a first side and a second portion coupled to the first portion and providing a second plurality of bearing support surfaces on a second side opposite the first side. The first camshaft assembly may be rotationally supported by the first camshaft housing assembly and arranged between the first portion and second portion.

A method of assembling an engine assembly may include providing a first camshaft housing assembly having a first portion providing a first plurality of bearing support surfaces on a first side and a second portion coupled to the first portion and providing a second plurality of bearing support surfaces on a second side opposite the first side. The method may further include arranging a first camshaft assembly in the second portion such that the first camshaft assembly contacts the second plurality of bearing support surfaces. The first portion may be coupled with the second portion such that the first camshaft assembly is arranged between the first portion and second portion and the first camshaft assembly contacts the first plurality of bearing support surfaces. The first camshaft housing assembly with the first camshaft assembly arranged between the first portion and second portion may be coupled to an engine structure.

A central direct injection engine assembly may include an engine structure, an intake camshaft housing assembly, an intake camshaft assembly, an exhaust camshaft housing assembly and an exhaust camshaft assembly. The engine structure may include a cylinder head that defines an aperture. The intake camshaft housing assembly may be supported by the engine structure and have a first portion providing a first plurality of bearing support surfaces on a first side and a second portion coupled to the first portion with a first plurality of fasteners and providing a second plurality of bearing support surfaces on a second side opposite the first side. The intake camshaft housing assembly may be coupled to the cylinder head by a second plurality of fasteners. The intake camshaft assembly may be rotationally supported by the intake camshaft housing assembly and arranged between the first portion and the second portion. The exhaust camshaft housing assembly may be supported by the engine structure and have a third portion providing a third plurality of bearing support surfaces on a third side and a fourth portion coupled to the third portion with a third plurality of fasteners and providing a fourth plurality of bearing support surfaces on a fourth side opposite the third side. The exhaust camshaft assembly may be rotationally supported by the exhaust camshaft housing assembly and arranged between the third portion and the fourth portion. The exhaust camshaft housing assembly may be coupled to the cylinder head by a fourth plurality of fasteners such that the aperture is arranged between the first camshaft housing assembly and the second camshaft housing assembly.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only and are not intended to limit the scope of the present disclosure in any way.

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Figure 1:
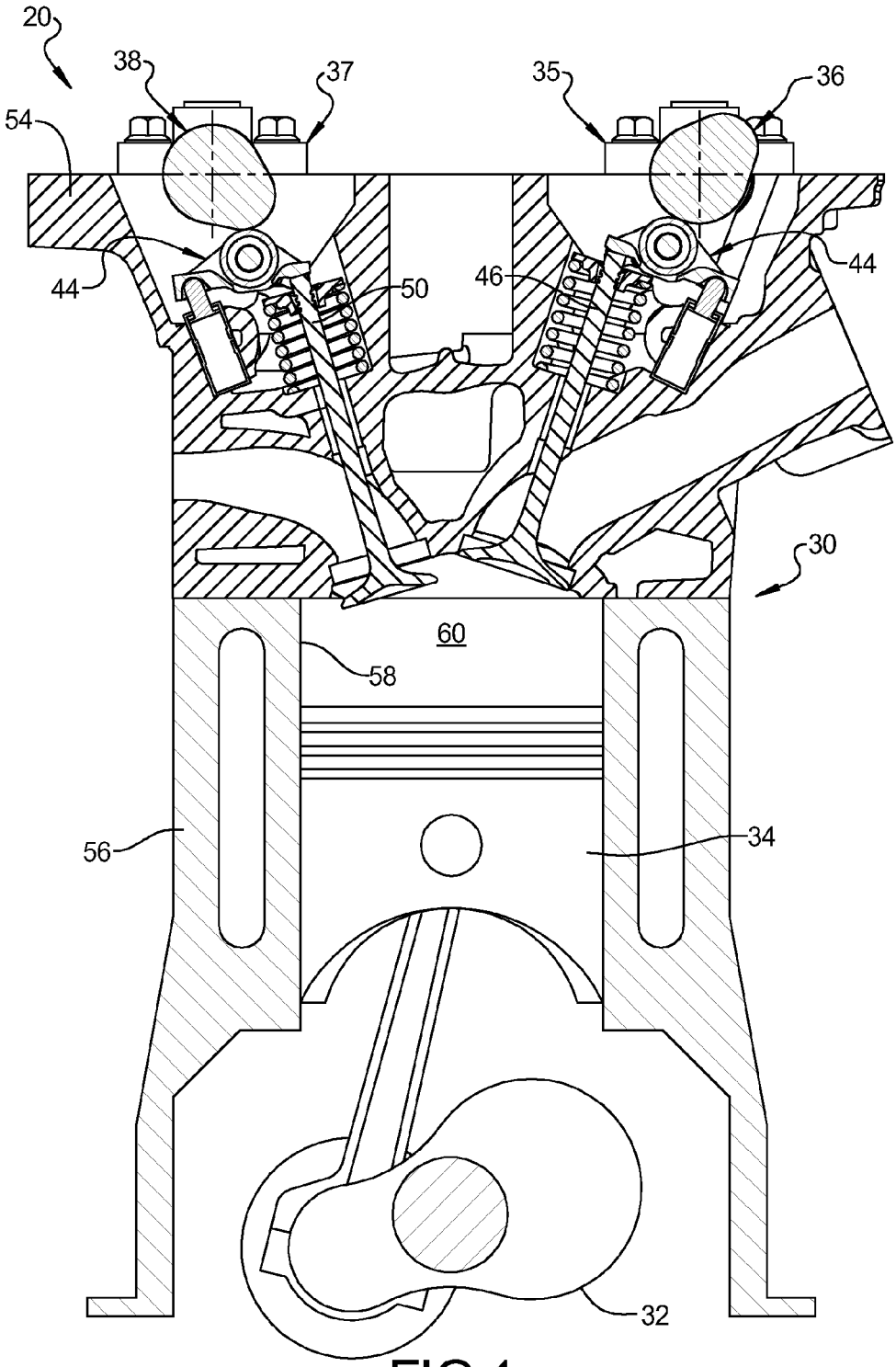
FIG. 1 is a schematic section view of an engine assembly according to the present disclosure.
Figure 2:
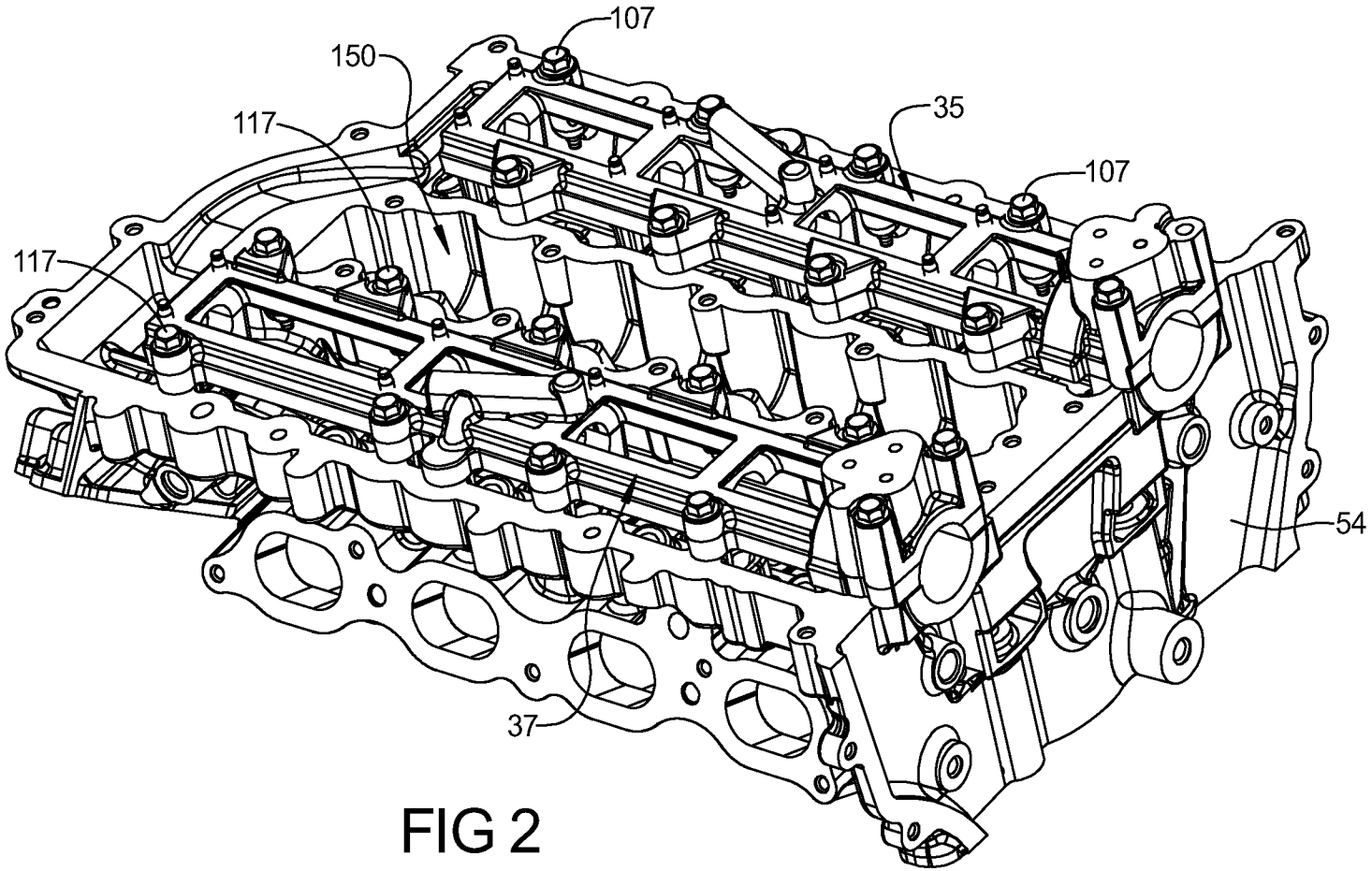
FIG. 2 is a partial perspective view of the engine assembly of FIG. 1.
Figure 3:
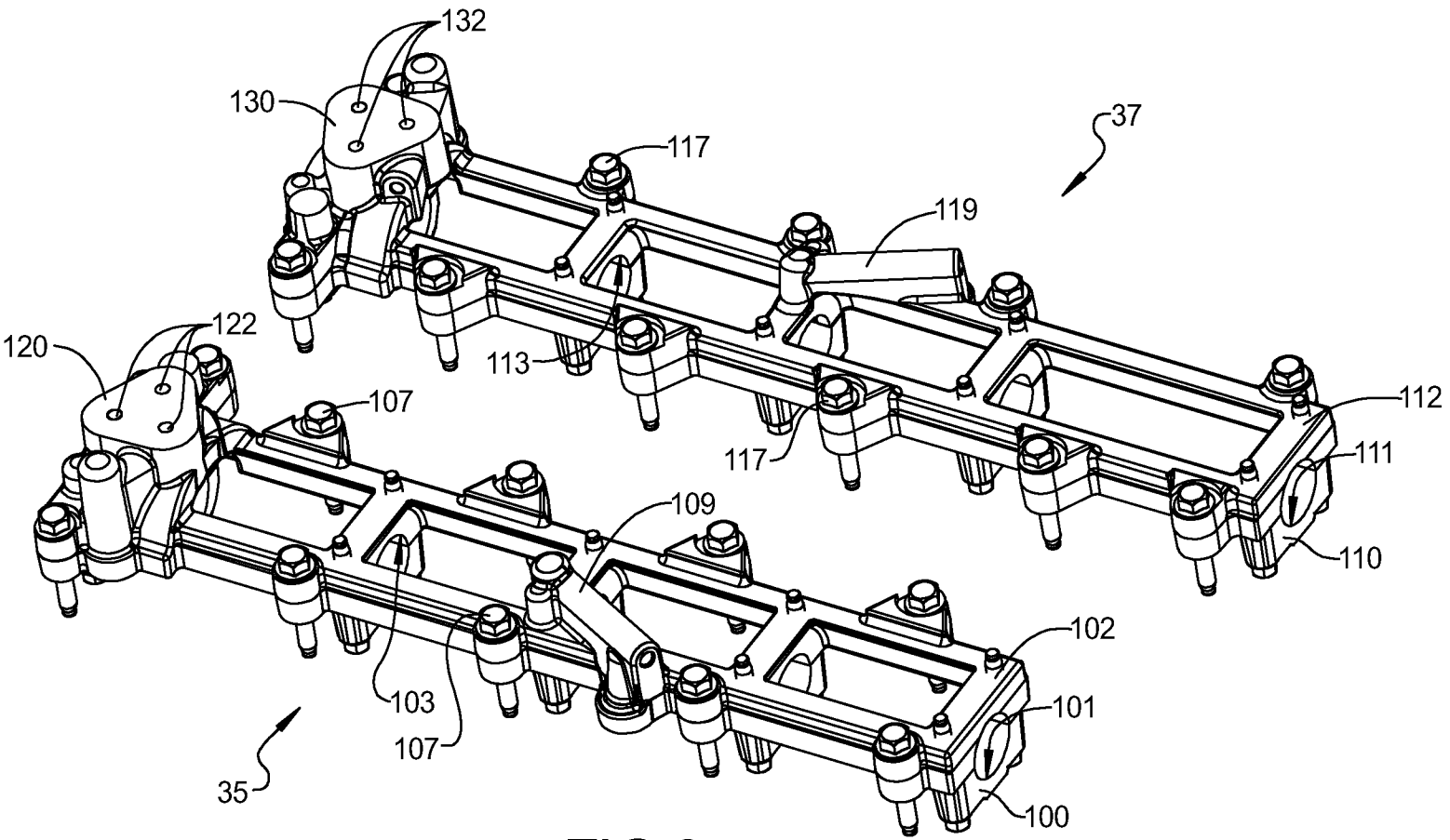
FIG. 3 is a partial perspective view of a camshaft housing assembly of the engine assembly of FIG. 1.
Figure 4:
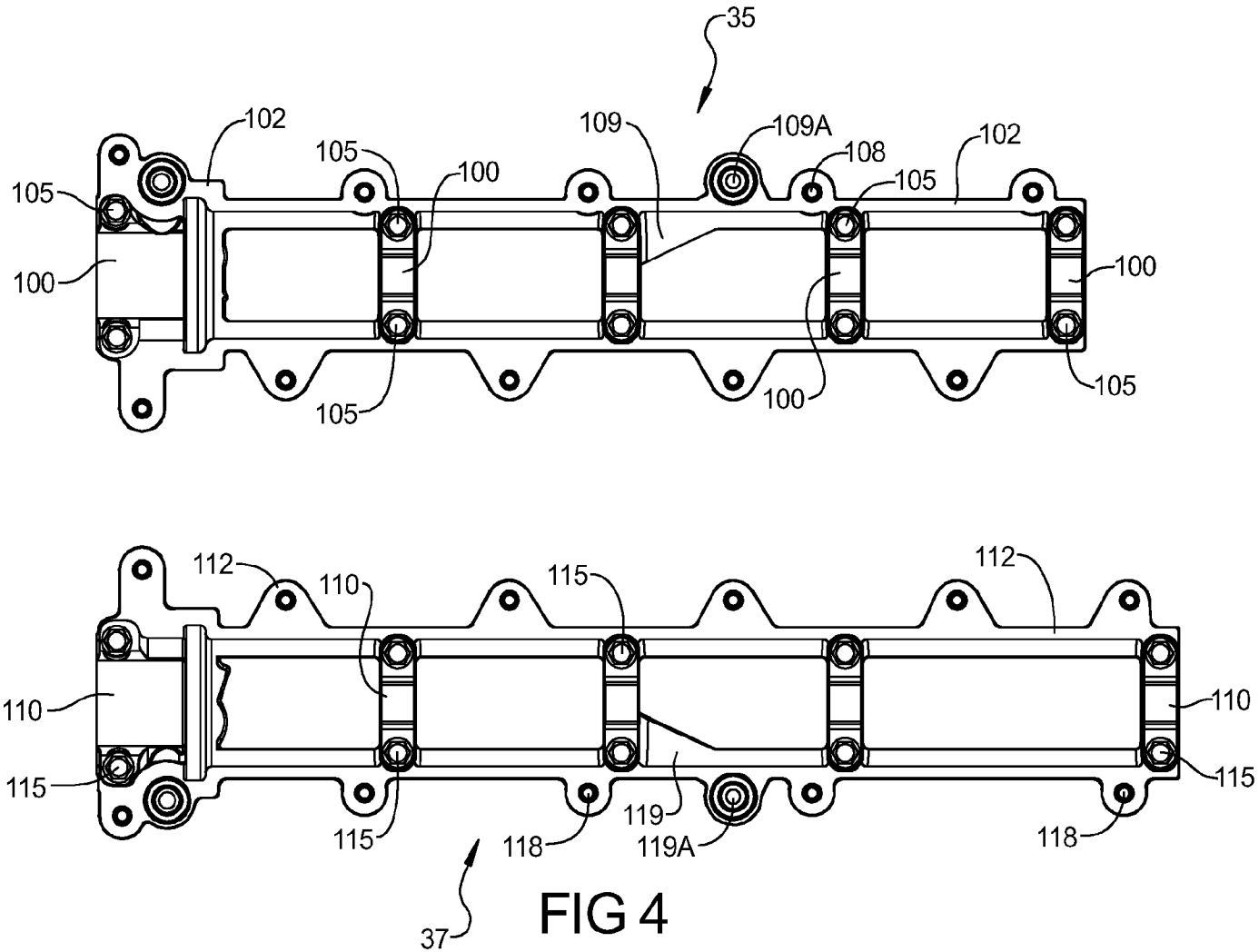
FIG. 4 is a partial perspective view of the camshaft housing assembly of FIG. 3.

With reference to FIG. 1, an engine assembly 20 may include an engine structure 30, a crankshaft 32 rotationally supported by the engine structure 30, one or more pistons 34 coupled to the crankshaft 32 and reciprocally displaceable between a top dead center position and a bottom dead center position, first and second camshaft housing assemblies (such as intake and exhaust camshaft housing assemblies 35, 37) supported on the engine structure 30, first and second camshaft assemblies (such as intake and exhaust camshaft assemblies 36, 38) rotationally supported on the intake and exhaust camshaft housing assemblies 35, 37, respectively, valve lift assemblies 44, at least one intake valve 46, and at least one exhaust valve 50. The engine structure 30 may include an engine block 56 and cylinder head 54. The engine block 56 may define cylinder bores 58. The cylinder head 54 and the cylinder bores 58 in the engine block 56 may cooperate to define combustion chambers 60. In the present non-limiting example, the engine assembly 20 is shown as a dual overhead camshaft engine with the engine structure 30 having the cylinder head 54 supporting the intake and exhaust camshaft housing assemblies 35, 37. It is understood, however, that the present disclosure is not limited to overhead camshaft configurations.

Referring now to FIGS. 2-5, exemplary intake and exhaust camshaft housing assemblies 35, 37 are illustrated. The intake camshaft housing assembly 35 may include a first portion 100 coupled to a second portion 102. The first portion 100 may provide a first plurality of bearing surfaces 101 on a first side to rotationally support the intake camshaft assembly 36. The second portion 102 may provide a second plurality of bearing surfaces 103 to rotationally support the intake camshaft assembly 36 on a second side opposite to the first side corresponding to the first plurality of bearing surfaces 101. In a non-limiting example, the first portion 100 may be coupled to the second portion 102 by a first plurality of fasteners 105. Intake camshaft assembly 36 may include a plurality of lobes 136 arranged along its length.

Similar to intake camshaft housing assembly 35 described above, the exhaust camshaft housing assembly 37 may include a third portion 110 coupled to a fourth portion 112. The third portion 110 may provide a third plurality of bearing surfaces 111 on a third side to rotationally support the exhaust camshaft assembly 38. The fourth portion 112 may provide a fourth plurality of bearing surfaces 113 to rotationally support the exhaust camshaft assembly 38 on a fourth side opposite to the third side corresponding to the third plurality of bearing surfaces 111. In a non-limiting example, the third portion 110 may be coupled to the fourth portion 112 by a third plurality of fasteners 115. Exhaust camshaft assembly 38 may include a plurality of lobes 138 arranged along its length.

Figure 5:
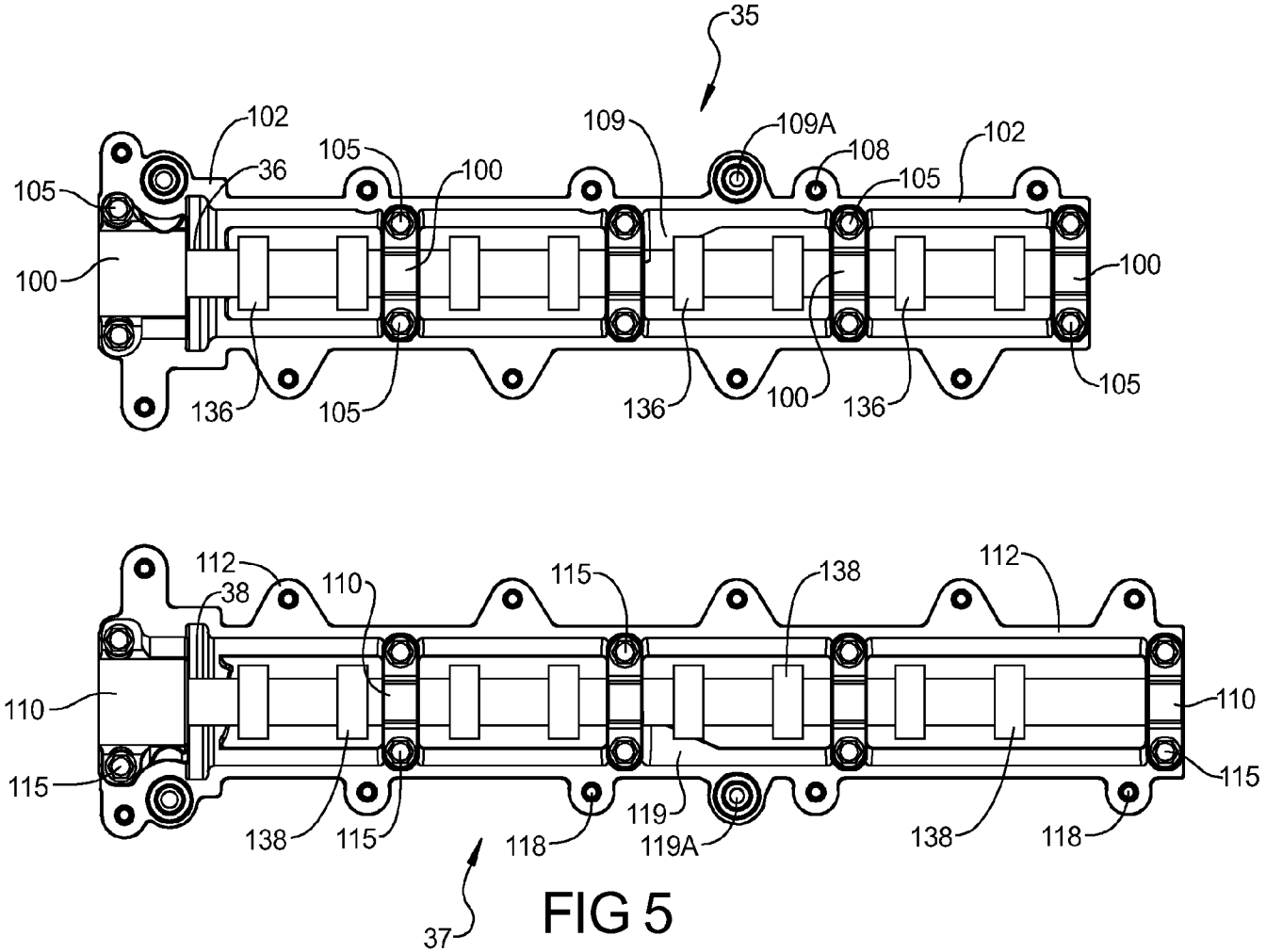
FIG. 5 is a partial perspective view of the camshaft housing assembly of FIG. 3.

The intake camshaft assembly 36 may be arranged between and rotationally supported by the first and second plurality of bearing surfaces 101, 102 of the intake camshaft housing assembly 35 (FIG. 5). The exhaust camshaft assembly 38 may be arranged between and rotationally supported by the third and fourth plurality of bearing surfaces 111, 112 of the exhaust camshaft housing assembly 37 (FIG. 5). The intake and exhaust camshaft housing assemblies 35, 37, with intake and exhaust camshaft assemblies 36, 38 arranged therein, may be coupled to and supported by the engine structure 30.

In a non-limiting example, the intake and exhaust camshaft housing assemblies 35, 37, with intake and exhaust camshaft assemblies 36, 38 arranged therein, may be coupled to and supported by the cylinder head 54. The intake camshaft housing assembly 35 may be coupled to cylinder head 54 by a second plurality of fasteners 107 that pass through openings 108 in second portion 102 and fasten to cylinder head 54. Similarly, exhaust camshaft housing assembly 37 may be coupled to cylinder head 54 by a fourth plurality of fasteners 117 that pass through openings 118 in fourth portion 112 and fasten to cylinder head 54.

Oil may be provided to the intake and exhaust camshaft housing assemblies 35, 37, e.g., in order to lubricate the intake and exhaust camshaft assemblies 36, 38. In a non-limiting example, intake camshaft housing assembly 35 may include one or more lubrication structures 109 to provide routing from an oil supply (not shown) to the intake camshaft housing assembly 35 and intake camshaft assembly 36. A first port 109A may be defined in lubrication structure 109 to couple to the oil supply. Similarly, exhaust camshaft housing assembly 37 may include one or more lubrication structures 119 to provide routing from an oil supply (not shown) to the exhaust camshaft housing assembly 37 and exhaust camshaft assembly 38. A second port 119A may be defined in lubrication structure 119 to couple to the oil supply.

In a non-limiting example, one or both of the intake and exhaust camshaft assemblies 36, 38 may include cam phasers for providing variable valve timing. Intake and exhaust camshaft housing assemblies 35, 37 may include phaser lubrication structures 120, 130, respectively, to provide oil to the cam phasers. Phaser lubrication structure 120 may include a plurality of oil ports 122 for receiving pressurized oil to operate the cam phaser of the intake camshaft assembly 36. Oil ports 122 may include an advance port for advancing the cam phaser and a retard port for retarding the cam phaser. Similarly, phaser lubrication structure 130 may include a plurality of oil ports 132 for receiving pressurized oil to operate the cam phaser of the exhaust camshaft assembly 38. Oil ports 132 may include an advance port for advancing the cam phaser and a retard port for retarding the cam phaser.

For example only, the engine assembly may be a central direct injection engine. In this type of engine, the intake and exhaust camshaft housing assemblies 35, 37 and camshaft assemblies 36, 38, when coupled to the cylinder head 54, may be separated by an aperture 150 formed in the cylinder head 54. The spark plugs and fuel injectors to be utilized with the engine assembly 20 may be arranged within the aperture 150. Oil that lubricates the intake and exhaust camshaft assemblies 36, 38 may be prevented from entering the aperture 150, for example by covering the intake and exhaust camshaft housing assemblies 35, 37 with a cam cover (not shown).

Engine assembly 20 may be assembled as follows. For example only, intake camshaft assembly 36 may be arranged in the second portion 102 of the intake camshaft housing assembly 35. Bearing surfaces on intake camshaft assembly 36 may be brought into contact with the second plurality of bearing surfaces 103 of the second portion 102. The first portion 100 may be coupled with the second portion 102 such that the intake camshaft assembly 36 is arranged between the first and second portions 100, 102 and the bearing surfaces on intake camshaft assembly 36 are brought into contact with the first plurality of bearing surfaces 101 of the first portion 100. The first and second portions 100, 102 may be coupled together with a plurality of fasteners 105.

Similarly, exhaust camshaft assembly 38 may be arranged in the fourth portion 112 of the exhaust camshaft housing assembly 37. Bearing surfaces on exhaust camshaft assembly 38 may be brought into contact with the fourth plurality of bearing surfaces 113 of the fourth portion 112. The third portion 110 may be coupled with the fourth portion 112 such that the exhaust camshaft assembly 38 is arranged between the third and fourth portions 110, 112 and the bearing surfaces on exhaust camshaft assembly 38 are brought into contact with the third plurality of bearing surfaces 111 of the third portion 110. The third and fourth portions 110, 112 may be coupled together with a plurality of fasteners 115.

The intake and exhaust camshaft housing assemblies 35, 37 (with their associated intake and exhaust camshaft assemblies 36, 38) may then be coupled to the engine structure 30, for example, cylinder head 54. In a non-limiting example, cylinder head 54 is coupled with engine block 56 before the intake and exhaust camshaft housing assemblies 35, 37 (and associated camshaft assemblies 36, 38) are coupled to the cylinder head 54. In this manner, the intake and exhaust camshaft housing assemblies 35, 37 may be located in a position that restricts access to the fasteners (for example, head bolts) utilized to couple the cylinder head 54 with the engine block 56, thus reducing the overall size of the engine assembly 20.

What is claimed is:

1. An engine assembly comprising:

an engine structure;

a first camshaft housing assembly supported by the engine structure and having a first unitary lower portion providing a first plurality of bearing support surfaces on a first side and a second unitary upper portion coupled to the first unitary lower portion and providing a second plurality of bearing support surfaces on a second side opposite the first side; and a first camshaft assembly rotationally supported by the first camshaft housing assembly and arranged between the first unitary lower portion and the second unitary upper portion, wherein the unitary second upper portion of the first camshaft housing assembly includes a lubrication structure for routing oil from an oil supply to the first camshaft assembly and the unitary second upper portion of the first camshaft housing assembly includes a phaser lubrication structure for routing oil from the oil supply to a cam phaser.

2. The engine assembly of claim 1 further comprising:

a second camshaft housing assembly supported by the engine structure and having a third portion providing a third plurality of bearing support surfaces on a third side and a fourth portion coupled to the third portion and providing a fourth plurality of bearing support surfaces on a fourth side opposite the third side; and a second camshaft assembly rotationally supported by the second camshaft housing assembly and arranged between the third portion and the fourth portion.

3. The engine assembly of claim 2, wherein the first camshaft housing assembly is an intake camshaft housing assembly and the second camshaft housing assembly is an exhaust camshaft housing assembly.

4. The engine assembly of claim 3, wherein the first portion is coupled to the second portion by a first plurality of fasteners.

5. The engine assembly of claim 4, wherein the first camshaft housing assembly is coupled to the engine structure by a second plurality of fasteners.

6. The engine assembly of claim 3, wherein the engine structure includes a cylinder head that defines an aperture arranged between the first camshaft housing assembly and the second camshaft housing assembly.

7. The engine assembly of claim 1, wherein the first portion is coupled to the second portion by a first plurality of fasteners.

8. The engine assembly of claim 7, wherein the first camshaft housing assembly is coupled to the engine structure by a second plurality of fasteners.

9. The engine assembly of claim 1, wherein the engine assembly is a central direct injection engine.

10. A central direct injection engine assembly comprising:

an engine structure including a cylinder head that defines an aperture;

an intake camshaft housing assembly supported by the engine structure and having a first unitary lower portion providing a first plurality of bearing support surfaces on a first side and a second unitary upper portion coupled to the first unitary lower portion with a first plurality of fasteners and providing a second plurality of bearing support surfaces on a second side opposite the first side, the intake camshaft housing assembly coupled to the cylinder head by a second plurality of fasteners;

an intake camshaft assembly rotationally supported by the intake camshaft housing assembly and arranged between the first unitary lower portion and the second unitary upper portion, wherein the second unitary upper portion of the intake camshaft housing assembly includes a lubrication structure for routing oil from an oil supply to the intake camshaft assembly and the second unitary upper portion of the intake camshaft housing assembly includes a phaser lubrication structure for routing oil from the oil supply to a cam phaser;

an exhaust camshaft housing assembly supported by the engine structure and having a third unitary lower portion providing a third plurality of bearing support surfaces on a third side and a fourth unitary upper portion coupled to the third unitary lower portion with a third plurality of fasteners and providing a fourth plurality of bearing support surfaces on a fourth side opposite the third side; and an exhaust camshaft assembly rotationally supported by the exhaust camshaft housing assembly and arranged between the third unitary lower portion and the fourth unitary upper portion, the exhaust camshaft housing assembly coupled to the cylinder head by a fourth plurality of fasteners such that the aperture is arranged between the first camshaft housing assembly and the second camshaft housing assembly.

* * * * *